United States Patent [19]

Helm et al.

[11] Patent Number: 4,741,069

[45] Date of Patent: May 3, 1988

[54] MOBILE WET CLEANING MACHINE

[76] Inventors: Kurt Helm, Plaggen 14, 2061 Nahe; Dieter Thiel, Helgolandstr. 21, 2400 Luebeck, both of Fed. Rep. of Germany

[21] Appl. No.: 931,335

[22] Filed: Nov. 14, 1986

[30] Foreign Application Priority Data

Nov. 16, 1985 [DE] Fed. Rep. of Germany ..... 3540783

[51] Int. Cl.[4] ..... A47L 11/283; A47L 11/30

[52] U.S. Cl. ..... 15/320; 15/353

[58] Field of Search ..... 15/320, 353

[56] References Cited

U.S. PATENT DOCUMENTS 1,736,446 11/1929 Keefer ..... 15/320 X
3,011,206 12/1961 Breither ..... 15/320
3,996,640 12/1976 Blue et al. ..... 15/320
4,348,783 9/1982 Swanson et al. ..... 15/320
4,377,017 3/1983 Herpers et al. ..... 15/320
4,464,810 8/1984 Karpanty ..... 15/320

*Primary Examiner*—Chris K. Moore
*Attorney, Agent, or Firm*—Emrich & Dithmar

[57] ABSTRACT

A mobile wet cleaning machine contains a first tank for the cleaning fluid which is supplied to a drivable cleaning tool, and a second tank into which is passed, cleaning fluid taken up from the floor surface being cleaned, the second tank being in fluid communication with the cleaning tool either directly or through the first tank, to permit used cleaning fluid, after filtering in the second tank, to flow under the force of gravity from the second tank to the cleaning tool for reuse.

19 Claims, 3 Drawing Sheets

MOBILE WET CLEANING MACHINE

BACKGROUND OF THE INVENTION

The invention relates to a mobile wet cleaning machine with a first tank for cleaning fluid, which is passed from said tank into the action region of at least one drivable cleaning tool for the floor surface to be cleaned, and with a second tank provided with a filter means, into which is introduced by means of a suction pipe the cleaning fluid taken up from the floor surface by a suction foot and from which cleaning fluid can be introduced into the first tank.

In one known wet cleaning machine of this type, which is marketed by the Tennant Company, Minneapolis, U.S.A. under the designation Tennant 527 SRS, the fluid comprising dirty water is sucked from the floor into the second tank, which comprises two portions. The first portion of the second tank receives the dirty water and includes a filter through which the water passes into the second portion. The filtered water is sucked by a pump from the second portion of the second tank to the brushes. An additional filter closes the inlet port to the pump line to prevent passage of any dirt particles which have entered the second portion into the pump.

This known wet cleaning machine, which has a relatively large construction, admittedly makes it possible to reuse the cleaning fluid and therefore provides a relatively long operating period before the entire cleaning fluid is used up and therefore refilling is necessary. However, it has a relatively complicated and costly construction, particularly due to the fact that it requires a pump, for which additional driving energy is required, for transporting fluid from the first portion of the second portion of tank to the second portion of the second tank.

It is also known to place a flexible bag with clean water in the dirty water tank of a small wet cleaning machine and from it the water for the cleaning process can be taken, so that the bag volume gradually decreases. Thus, there is a reduction in the degree of filling of the dirty water tank and the volume which is becoming free can be filled with dirty water.

Although this known wet cleaning machine has a compact construction and can also be constructed as a small unit, it suffers from the disadvantage that the volume of the cleaning fluid quantity to be used during a cycle is limited by the clean water bag volume, because the dirty water sucked up from the floor cannot be reused.

SUMMARY OF THE INVENTION

The present invention provides a wet cleaning machine that is of simple, compact construction and permits reuse of the cleaning fluid, without additional expenditure of energy being necessary for this.

According to the invention, a mobile wet cleaning machine includes at least one drivable cleaning tool for cleaning floor surfaces. The cleaning machine comprises fluid storage means defining first and second fluid storage compartments for storing cleaning fluid and means coupled to the first fluid storage compartment for passing fluid from the first fluid storage compartment into the action area of the cleaning tool for a floor surface to be cleaned. A transfer means has a fluid inlet located adjacent to the floor surface and a fluid outlet communicating with the second fluid storage compartment. The transfer means removes used cleaning fluid from the floor surface and introduces it into the second fluid storage compartment for storage therein. A fluid passageway is defined between the second compartment and the cleaning tool, permitting fluid to flow from the second fluid storage compartment to the cleaning tool solely under the force of gravity. The second fluid storage compartment includes filter means for filtering used cleaning fluid introduced thereinto by the transfer means prior to the passing of the used fluid to the fluid passageway.

According to a feature of the present invention, the cleaning fluid taken up from the floor can be reused for cleaning purposes, without having to use a pump or any other energy-consuming member, the fluid being transported from the second tank to the cleaning tool either directly or through the first tank solely under the force of gravity.

According to another aspect of the invention, the two tanks are separated by a common wall providing a particularly compact construction for the wet cleaning machine.

According to one embodiment, a fluid communicating connection is provided between the second tank and the cleaning tool for transporting fluid under the force of gravity directly from the second tank to the cleaning tool. In a further embodiment, a fluid communicating connection is provided between the two tanks by a generally U-shaped conduit, for transporting fluid under the force of gravity through the first tank to the cleaning tool, the conduit preferably being closable so as to be able to interrupt the connection between the two tanks if it is not intended to reuse the cleaning fluid which has been taken up.

In accordance with another embodiment of the invention, wherein the two tanks are separated from one another by a common wall, an opening is provided in the lower region of the common wall forming an outlet port for the second tank and this opening is optionally closable. In this construction, the opening provides a fluid interconnection between the two tanks. Also, the wall common to the two tanks may comprise the filter means which is in the form of a fine filter, so that cleaning fluid taken up can pass through this filter from the second tank into the first tank, while dirt particles are retained by the filter.

The invention consists of certain novel features and structural details hereinafter fully described, illustrated in the accompanying drawings, and particularly pointed in the appended claims, it being understood that various changes in the details may be made without departing from the spirit, or sacrificing any of the advantages of the present invention.

DESCRIPTION OF THE DRAWINGS

For the purpose of facilitating and understanding the invention, there is illustrated in the accompanying drawing a preferred embodiment thereof, from an inspection of which, when considered in connection with the following description, the invention, its construction and operation, and many of its advantages will be readily understood and appreciated.

DESCRIPTION OF THE PREFERRED EMBODIMENT

Figure 1:
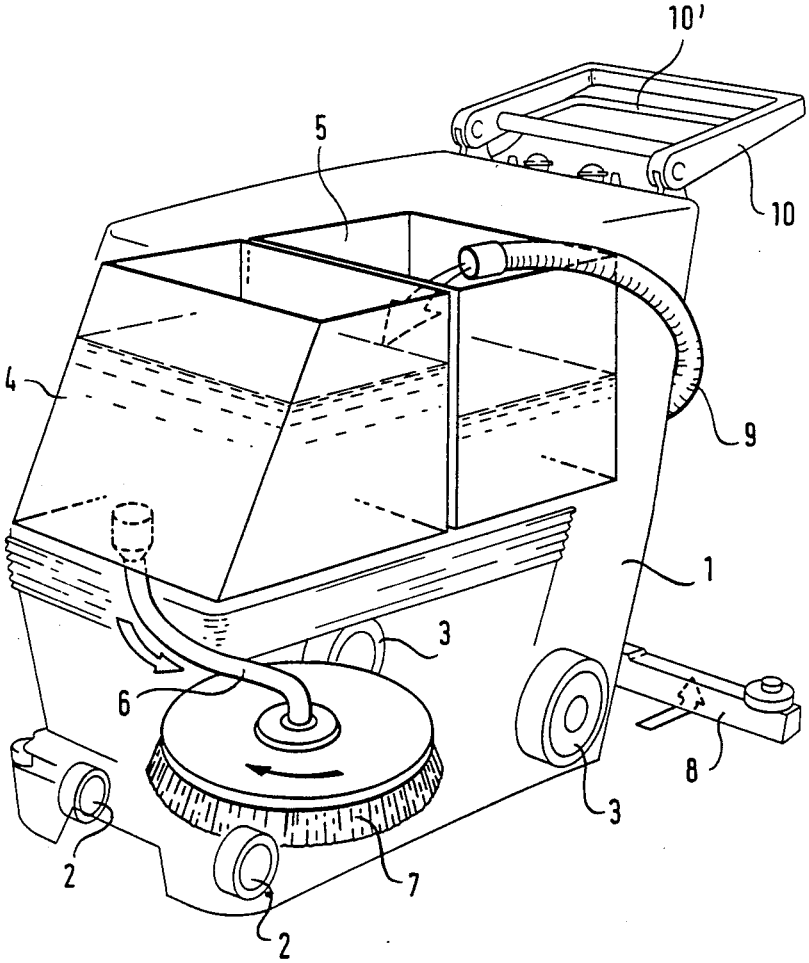
FIG. 1 is a diagrammatic perspective view of a wet cleaning machine of the present type.

The wet cleaning machine shown in FIG. 1 is a machine guided by the user by action on operating spar 10. The machine runs on wheels 2, 3 and has a disc-shaped cleaning brush 7, which in operation is driven in the direction of the arrow. The forward drive of the wet cleaning machine takes place in known manner by a slightly inclined position of cleaning brush 7, so that the portion of cleaning brush 7 engaging the floor provides a forward drive action.

Cleaning fluid is supplied to cleaning brush 7 by means of a hose 6 from a first tank 4 housed in the cleaning machine casing 1. This fluid assists the cleaning process and is sucked up in known manner by suction foot 8 behind the cleaning machine casing 1 and is passed by means of a hose 9 into a second tank 5.

For operating the wet cleaning machine, the user pivots the handle 10' in the direction of the operating spar 10, so that the motor (not shown in FIG. 1) rotates cleaning brush 7. The water supply and suction process takes place in known manner. As soon as the user releases handle 10', the operation of the wet cleaning machine is stopped.

Figure 2:
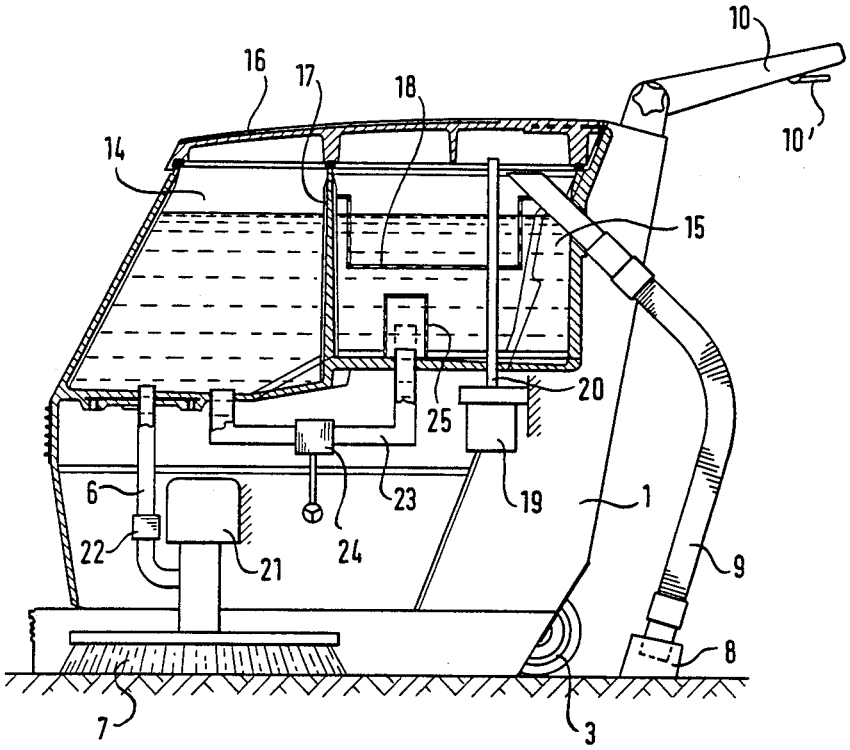
FIG. 2 is a partial sectional view of a wet cleaning machine having tanks linked in communication by a generally U-shaped pipe.

The wet cleaning machine shown in FIG. 2 has fundamentally the same construction as the wet cleaning machine of FIG. 1 and the same parts are designated with the same reference numerals.

It can be seen that cleaning brush 7 is driven by an electric motor 21. Hose 6, which can also be in the form of a rigid pipe, contains a valve 22, which in the inoperative position of the machine prevents cleaning fluid from flowing out of the first tank 14. Tank 14 essentially corresponds to tank 4 of FIG. 1, while the tank 15 positioned alongside tank 14 corresponds to tank 5 of FIG. 1. It can be seen that the tanks 14 and 15 are separated from one another by a common wall 17 and are closed by a cover 16 articulated to casing 1.

A pump 19 housed in casing 1 produces a vacuum in the area above tank 15 in the conventional manner by means of a pipe 20 and with the aid of said vacuum the consumed cleaning fluid, conventionally water, is sucked up from the floor by means of suction foot 8 and is conveyed via hose 9 into tank 15.

Cleaning fluid is transported from the second tank 15 to the cleaning brush 7 under the force of gravity, either directly or through the first tank 14. In FIG. 2, the two tanks 14, 15 are shown interconnected by a pipe 23, the ends of which pass through the bottoms of the particular tanks. The bottom of tank 15 is located vertically higher than the bottom of tank 14. The pipe contains a manually operated slide valve 24. The pipe end issuing into tank 5 is covered by a cup-shaped fine filter 25, which can be made from a plastic or metal cloth. A grid-like coarse filter 18 for trapping larger dirt particles or debris is suspended in tank 15 and can be in the form of a metal or plastic sieve and into it issues the outlet end of hose 9.

If slide valve 24 is open in operation, then the two tanks 14, 15 communicate with one another. For floor cleaning purposes, cleaning fluid flows out of tank 14, through pipe 6 to the cleaning brush 7 driven by motor 21 and the wet cleaning machine is moved over the floor in the manner explained in conjunction with FIG. 1. The cleaning fluid left on the floor is sucked up by suction foot 8 and is passed by means of hose 9 into tank 15, larger dirt particles being retained in course filter 18. As a result of the communicating U-tube like connection of tanks 14 and 15, cleaning fluid from tank 15 passes under the force of gravity via pipe 23 into tank 14 and is again supplied to cleaning brush 7. Dirt particles which have passed through course filter 18 are retained in tank 15 by fine filter 25, so that tank 14 always contains substantially cleaned, cleaning fluids.

Alternatively, the connection between the first tank 14 and the second tank 15 may be omitted and the output end of pipe 23 (and valve 24) may be connected directly into hose 6 by a "tee" connection (not shown) in which case, the fluid is transported by gravity directly from tank 15 to the brush 7.

If the wet cleaning machine according to FIG. 2 is to be operated in conventional manner, slide valve 24 is closed. In such operation, the cleaning fluid from tank 14 is used for the cleaning process and spent or consumed cleaning fluid is taken up from the floor by suction foot 8 and is fed by hose 9 into tank 15. When the cleaning fluid in tank 14 has been used up, refilling of cleaning fluid, is necessary and then it is possible to remove the spent cleaning fluid from tank 15.

Figure 3:
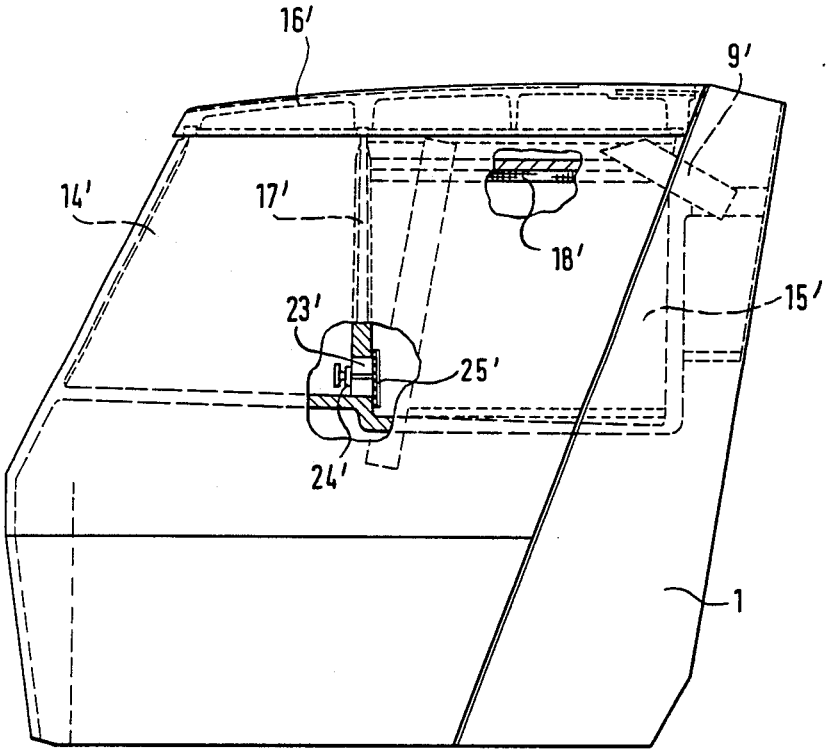
FIG. 3 is a diagrammatic partial representation of a wet cleaning machine similar to that of FIG. 2, the communicating connection between the two tanks being formed by an opening in their common partition.

In the case of the partly represented cleaning machine in FIG. 3, corresponding parts are designated with the same reference numerals as in FIG. 2, with a prime notation added thereto.

The wet cleaning machine according to FIG. 3 differs from that according to FIG. 2 essentially only in that the communicating connection of tanks 14' and 15' is provided by an opening 23' in the common wall or partition 17', instead of by a conduit or pipe. Opening 23' is covered on the side facing tank 15' with a fine filter 25', such as one made from a plastic or metal cloth, and can be closed by means of a diagrammatically indicated slide valve 24', for which purpose the latter is raised from the position shown in FIG. 3 and secured in front of opening 23'.

In the embodiment according to FIG. 3, coarse filter 18' is essentially in the form of a flat frame which is hung in the upper part of tank 15' so that water is passed from hose 9' from above onto the filter.

It is pointed out that partition 17' can comprise a fine filter secured in a frame and/or can be inserted in a removable manner. The latter also applied with respect to the wall or partition 17 in FIG. 2.

We claim:

1. A mobile wet cleaning machine including at least one drivable cleaning tool for cleaning floor surfaces, comprising: fluid storage means defining first and second fluid storage compartments for storing cleaning fluid; means coupled to said first fluid storage compartment for passing fluid from said first fluid storage compartment into the action area of said cleaning tool for a floor surface to be cleaned; transfer means having a fluid inlet located adjacent to the floor surface and a fluid outlet communicating with said second fluid storage compartment, said transfer means removing used cleaning fluid from the floor surface and introducing it into said second fluid storage compartment for storage therein; means defining a fluid passageway between said second fluid storage compartment and said first fluid storage compartment to permit used fluid to flow from said second fluid storage compartment through said first fluid storage compartment to said cleaning tool solely under the force of gravity; said means defining a fluid passageway including a generally U-shaped conduit having a fluid inlet connected to a fluid outlet of said second fluid storage compartment and having a fluid outlet connected to a fluid inlet of said first fluid storage compartment; said second fluid storage compartment including filter means for filtering used cleaning fluid introduced thereinto by said transfer means prior to the passing of the used fluid to said passageway defining means.

2. A cleaning machine according to claim 1, wherein said inlet of said first fluid storage compartment and said outlet of said second fluid storage compartment are located in respective bottom surfaces, the bottom surfaces of said first and second fluid storage compartments being at different vertical heights.

3. A cleaning machine accordimg to claim 1, wherein said means defining a passageway further comprises flow control means in said conduit and operatable between flow permitting and flow preventing positions.

4. A cleaning machine according to claim 1, wherein said filter means comprises a first filter element located adjacent to said fluid outlet of said second fluid storage compartment for filtering fluid flowing therethrough and a second filter element suspended within said second fluid storage compartment and located adjacent to said fluid outlet of said transfer means.

5. A mobile wet cleaning machine including at least one drivable cleaning tool for cleaning floor surfaces, comprising: fluid storage means defining first and second fluid storage compartments separated by a common wall for storing cleaning fluid; means coupled to said first fluid storage compartment for passing fluid from said first fluid storage compartment into the action area of said cleaning tool for a floor surface to be cleaned; transfer means having a fluid inlet located adjacent to the floor surface and a fluid outlet communicating with said second fluid storage compartment, said transfer means removing used cleaning fluid from the floor surface and introducing it into said second fluid storage compartment for storage therein; said wall having an opening in the lower region thereof defining a fluid passageway between said second fluid storage compartment and said first fluid storage compartment to permit used fluid to flow from said second fluid storage compartment through said first fluid storage compartment to said cleaning tool solely under the force of gravity; said second fluid storage compartment including filter means for filtering used cleaning fluid introduced thereinto by said transfer means prior to the passing of the used fluid to said first fluid storage compartment.

6. A cleaning machine according to claim 5, including flow control means operatable between flow permitting and flow preventing positions for controlling fluid flow through said opening.

7. A cleaning machine according to claim 5, wherein said common wall comprises a filter element.

8. A cleaning machine according to claim 5, wherein said common wall is removably mounted within said storage means.

9. A cleaning machine according to claim 5, wherein said filter means comprises a filter element covering the opening which communicates said second fluid storage compartment with said first fluid storage compartment.

10. A mobile wet cleaning machine including at least one drivable cleaning tool for cleaning floor surfaces, comprising: a first tank for storing cleaning fluid; means for passing fluid from said first tank into the action area of said cleaning tool for a floor surface to be cleaned; a second tank for storing used cleaning fluid; suction means for removing used cleaning fluid from the floor surface and introducing it into said second tank for storage therein; means defining a fluid passageway between said second tank and said first tank to permit used fluid to flow from said second tank through said first tank to said cleaning tool solely under the force of gravity; said means defining a fluid passageway including a generally U-shaped conduit having a fluid inlet connected to a fluid outlet of said second tank and having a fluid outlet connected to a fluid inlet of said first tank; and filter means in said second storage tank for filtering used cleaning fluid introduced thereinto by said transfer means prior to the passing of the fluid to said passageway defining means.

11. A cleaning machine according to claim 10, wherein said inlet of said first tank and said outlet of said second tank are located in respective bottom surfaces thereof, the bottom surfaces of said first and second tanks being at different vertical heights.

12. A cleaning machine according to claim 11, wherein said means defining a passageway further comprises flow control means in said conduit and operatable between flow permitting and flow preventing positions.

13. A cleaning machine according to claim 10, wherein said filter means comprises a first filter element located adjacent to said fluid outlet of said second tank and a second filter element suspended within said second tank.

14. A cleaning machine according to claim 10, wherein said tanks are separated by a common wall.

15. A mobile wet cleaning machine including at least one drivable cleaning tool for cleaning floor surfaces, comprising: a first tank for storing cleaning fluid; means for passing fluid from said first tank into the action area of said cleaning tool for a floor surface to be cleaned; a second tank for storing used cleaning fluid; suction means for removing used cleaning fluid from the floor surface and introducing it into said second tank for storage therein; said first and second fluid storage tanks having a common wall therebetween with an opening in the lower region thereof providing a fluid passageway between said second tank and said first tank to permit used fluid to flow from said second tank through said first tank to said cleaning tool solely under the force of gravity; and filter means in said second storage tank for filtering used cleaning fluid introduced thereinto by said transfer means prior to the passing of the fluid to said passageway defining means.

16. A cleaning machine according to claim 15, including flow control means for the opening and operatable between flow permitting and flow preventing positions.

17. A cleaning machine according to claim 15, wherein said common wall comprises a filter element.

18. A cleaning machine according to claim 15, wherein said common wall is removably mounted.

19. A cleaning machine according to claim 15, wherein said filter means includes a filter element covering the opening.

* * * * *